United States Patent [19]

Scherer

[11] Patent Number: 4,906,961

[45] Date of Patent: Mar. 6, 1990

[54] RAIN SHIELD FOR EXPULSION-TYPE CIRCUIT INTERRUPTERS

[75] Inventor: Henry W. Scherer, Mt. Prospect, Ill.

[73] Assignee: S&C Electric Company, Chicago, Ill.

[21] Appl. No.: 282,139

[22] Filed: Dec. 9, 1988

[51] Int. Cl.[4] ..... H01H 85/20

[52] U.S. Cl. ..... 337/186; 337/168; 337/249

[58] Field of Search ..... 337/186, 199, 248, 249, 337/250, 168, 171, 282, 280

[56] References Cited

U.S. PATENT DOCUMENTS

| | | | |
|---|---|---|---|
| 3,258,568 | 6/1966 | Patterson et al. | 200/144 |
| 3,719,912 | 3/1973 | Harner et al. | 337/280 |
| 3,965,452 | 6/1976 | Chabala et al. | 337/280 |
| 4,001,750 | 1/1977 | Scherer et al. | 337/280 |
| 4,047,142 | 9/1977 | Bernatt et al. | 337/186 |
| 4,691,083 | 9/1987 | Dienes | 174/135 |

*Primary Examiner*—H. Broome
*Attorney, Agent, or Firm*—James V. Lapacek

[57] ABSTRACT

A rain shield for a circuit-interrupting device is provided that includes a housing for attachment to the circuit interrupter adjacent an exhaust outlet of the circuit interrupter. The rain shield prevents the ingress of moisture while providing a path for the exhaust gases of the circuit interrupter. The rain shield is selectively attachable to the circuit interrupter and is reusable. In one arrangement, the rain shield includes a housing which is generally cylindrical and has an inlet opening at a first end for cooperation with the exhaust outlet of the circuit interrupter. At a second opposite end of the housing, an outlet is defined that includes a predetermined pattern of openings. A centrally disposed plate is provided adjacent the outlet and functions as a drip cap such that moisture in the form of precipitation that enters the outlet of the rain shield is prevented from entering the inlet opening adjacent the circuit interrupter. When the circuit interrupter is in an inverted position, precipitation that directly enters the openings in the outlet of the rain shield is collected in a reservoir area of the housing. The reservoir in one particular configuration is formed between an inner wall that defines the inlet opening and an outer wall of the housing. Drain holes are provided through the outer wall of the housing that communicate with the reservoir such that water accumulating in the reservoir is drained from the inverted rain shield.

22 Claims, 2 Drawing Sheets

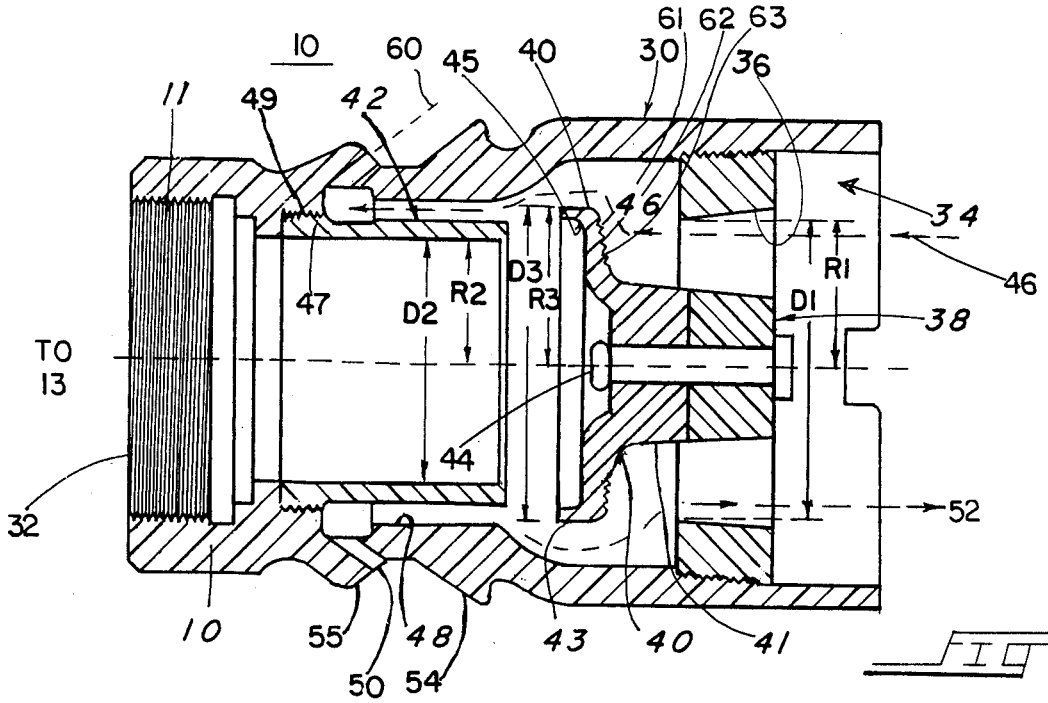
FIG-2
FIG-3
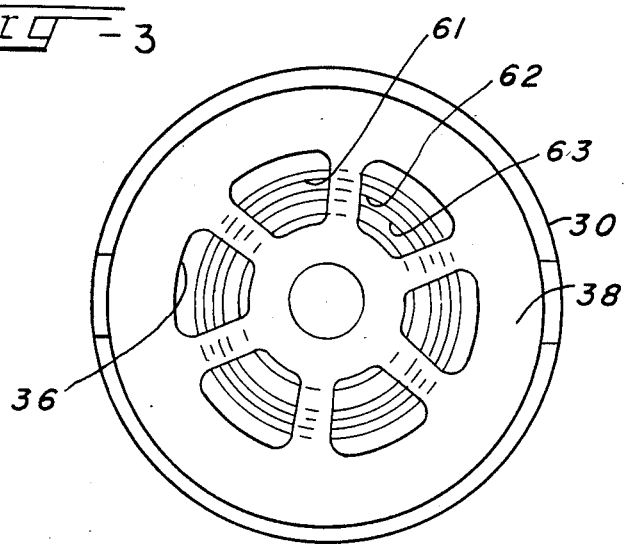
FIG-5
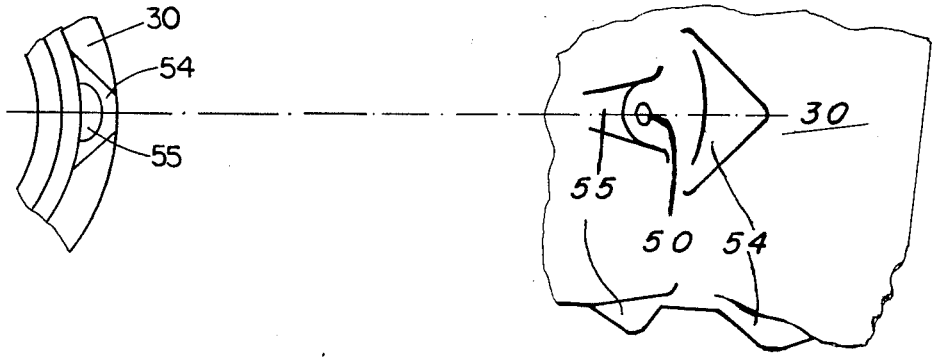
FIG-4

RAIN SHIELD FOR EXPULSION-TYPE CIRCUIT INTERRUPTERS

BACKGROUND OF THE INVENTION

1. Field of the Invention

The present invention relates generally to arrangements for preventing the ingress of precipitation to expulsion-type circuit interrupters and more particularly to an improved rain shield for such circuit interrupters.

2. Description of the Related Art

High-voltage circuit interrupters and particularly high-voltage expulsion-type fuses are well known in the art. For example, U.S. Pat. Nos. 3,267,235, 3,575,683, 3,176,100, 3,855,563, 4,153,893, 4,158,830 and 4,193,053 illustrate typical fuses for high-voltage electric power circuits and particularly those of the expulsion type. Such high-voltage circuit interrupters are often mounted outside on utility poles and thus are directly exposed to adverse weather conditions including rain, sleet, hail, and snow. In addition, it is common for circuit interrupters of this type to have an inverted, drop-out position (also referred to as a drop-down position). For some circuit interrupters, this position results via normal operation after circuit interruption. Additionally, the circuit interrupter may be manually opened to the inverted position by the use of appropriate handling tools. Since such high-voltage fuses usually comprise an arc-quenching or arc-extinguishing material such as boric acid, etc., which if exposed to excessive moisture will be degraded, various arrangements are utilized to reduce deleterious effects that may result from moisture ingress.

In order to provide protection against the direct ingress of precipitation and especially when the circuit interrupter is in the inverted, drop-out position, rain shields may be provided. Rain shields of both the gravity-operated flapper type and the clamp-on type are illustrated in Descriptive Bulletin 242-30 dated Apr. 30, 1984 at pages 12-15 for S&C Power Fuses-Types SM-4 and SM-5 manufactured by S&C Electric Company. While such rain-shield arrangements are very useful to help prevent the ingress of precipitation, such designs cannot be fully effective under all conditions, for example, with high winds and driving rains.

Various sealing methods can be utilized to prevent the ingress of moisture to the interior of the circuit interrupter. However, such methods may, over time, develop leaks.

U.S. Pat. No. 4,045,758 discloses an arrangement which aids in preventing lower than atmospheric pressures from being developed on the inside of the circuit interrupter due to temperature cycling and permits the interchange of air between the interior and the environment. A breather assembly, as disclosed in U.S. Pat. No. 4,047,142 permits atmospheric venting to the interior while preventing precipitation from entering the circuit interrupter. While the breather assembly is useful, the breather assembly is not reusable and is not practical for use with circuit interrupters having higher interrupting ratings.

BRIEF SUMMARY OF THE INVENTION

Accordingly, it is a principal object of the present invention to provide a reusable rain shield for expulsion-type circuit interrupters which prevents the ingress of precipitation even when the circuit interrupter is in a drop-out or inverted position with the exhaust end pointed upward, and which provides a path for exhaust gases during circuit-interrupting operation of the circuit interrupter.

It is another object of the present invention to provide a rain shield for expulsion-type circuit interrupters that prevents usage of the circuit interrupter in a mounting unless the rain shield is provided.

These and other objects of the present invention are achieved by the provision for a circuit-interrupting device of a rain shield which includes a housing for attachment to the circuit interrupter adjacent an exhaust outlet of the circuit interrupter. The rain shield prevents the ingress of moisture while providing a path for the exhaust gases of the circuit interrupter. Accordingly, the rain shield is selectively attachable to the circuit interrupter and is reusable. In one arrangement, the rain shield includes a housing which is generally cylindrical and has an inlet opening at a first end for cooperation with the exhaust outlet of the circuit interrupter. At a second opposite end of the housing, an outlet is defined that includes a predetermined pattern of openings. A centrally disposed plate is provided adjacent the outlet and functions as a drip cap. The drip cap is dimensioned in accordance with the predetermined pattern of openings in the outlet, such that moisture in the form of precipitation that enters the outlet of the rain shield is prevented from entering the inlet opening adjacent the circuit interrupter. When the circuit interrupter is in an inverted position, precipitation that directly enters the openings in the outlet of the rain shield are collected in a reservoir area of the housing. The reservoir in one particular configuration is formed between an inner wall that defines the inlet opening and an outer wall of the housing. Drain holes are provided through the outer wall of the housing that communicate with reservoir such that water accumulating in the reservoir is drained from the inverted rain shield; thus eliminating the potential for the accumulated water to enter the inlet opening adjacent the exhaust outlet of the circuit interrupter. The dimensions of the housing and the various components carried therein are interrelated so as to provide a suitable exhaust path for the exhaust gases that are expelled by the circuit interrupter-the exhaust gases entering the inlet opening at the first end of the housing, passing through the housing, and being expelled from the outlet at the second end. In the preferred arrangement, the housing of the rain shield cooperates with an attachment fitting at the exhaust end of the circuit interrupter such that the rain shield must be assembled to the circuit interrupter and the attachment fitting as a final assembly before the circuit interrupter can be retained within a mounting. In a particular arrangement, the attachment fitting is a trunnion which is threaded into mating threads of the housing to thereby retain the circuit interrupter. The trunnion interfits with a hinge provided on the mounting for the circuit interrupter.

BRIEF DESCRIPTION OF THE DRAWING

The invention, both as to its organization and method of operation, together with further objects and advantages thereof, will best be understood by reference to the following specification taken in conjunction with the accompanying drawing in which:

FIG. 2 is a sectional view of the rain shield of FIG. 1;

FIG. 3 is an elevational view of the rain shield of FIG. 1 taken from the outlet side thereof;

FIG. 4 is a view of a portion of the exterior of the rain shield; and

FIG. 5 is a partial elevational view of the rain shield of FIG. 1 taken from the inlet side thereof.

DETAILED DESCRIPTION

Figure 1:
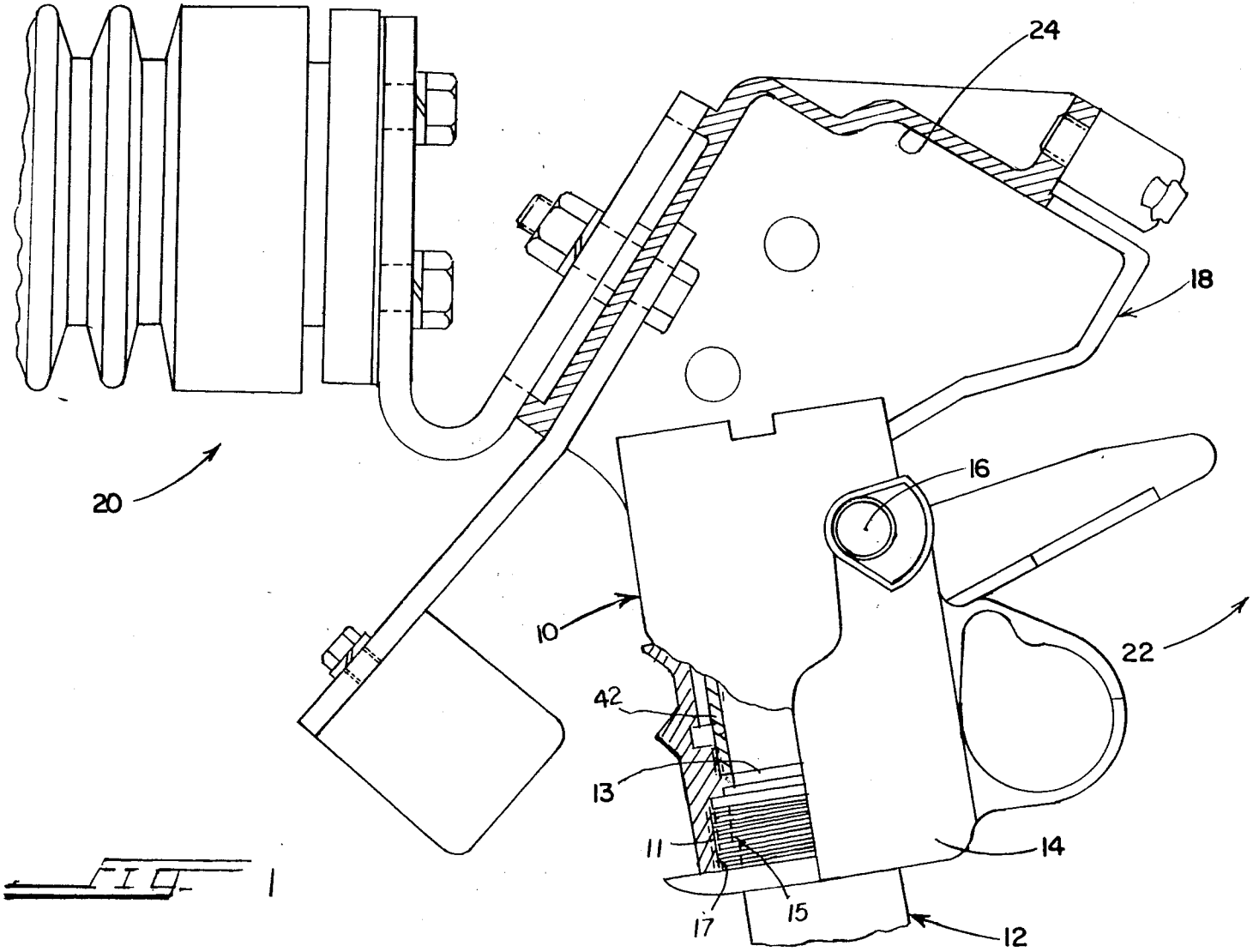
FIG. 1 is an elevational view partly in section of a portion of a circuit interrupter with an attachment fitting, the rain shield of the present invention, and a lower portion of a mounting for the circuit interrupter-the circuit interrupter being illustrated in the inverted, drop-out position.

Referring now to FIG. 1, the rain shield 10 of the present invention is illustrated as affixed to a circuit interrupter 12 via an attachment fitting 14. The attachment fitting 14 includes trunnion portions 16 that cooperate with a hinge 18. The hinge 18 is a lower portion of a mounting for the circuit interrupter; the mounting being referred to generally at 20. The rain shield 10 and the circuit interrupter 12 are illustrated in FIG. 1 in an open (drop-down or drop-out) inverted position which is generally about 180° from the closed, circuit-operating position. In the circuit-operating position, the circuit interrupter 12 assumes a nearly vertical position with respect to FIG. 1. The circuit-operating position is achieved by rotation of the assembled circuit interrupter 12, attachment fitting 14, and rain shield 10 in the direction 22. The inverted or drop-out position in FIG. 1 is automatically assumed after circuit interruption; the circuit interrupter 12 dropping down from the vertical operating position. With the circuit interrupter 12 in the inverted position illustrated in FIG. 1, a visible air gap is provided to inform operating personnel that the circuit is open. From the inverted position, the circuit interrupter 12 may be removed from the mounting 20.

In the inverted position of FIG. 1, it can be seen that while the hinge 18 is fabricated to include a solid roof portion 24 that cooperates with the placement of the trunnion portion 16 to enclose and shelter the rain shield 10 from the environment, it is still possible for precipitation due to blowing winds and the like to enter into the vicinity of the rain shield 10. Referring now additionally to FIGS. 2 and 3, the rain shield 10 includes a housing 30 defining an inlet opening 32 at a first end and an outlet 34 at a second end. As seen in FIG. 1, the attachment fitting 14 includes a lip portion 15 which functions as a locking collar which is affixed about the end portion of the circuit interrupter 12 to retain the circuit interrupter 12 to the rain shield 10 with an exhaust outlet 13 of the circuit interrupter 12 adjacent to and in communication with the inlet opening 32 of the rain shield 10. Specifically, a threaded portion 17 of the attachment fitting 14 is threaded into an internal threaded portion 11 of the rain shield 10 at the inlet opening 32.

Referring now additionally to FIG. 2, a predetermined pattern of holes or openings 36 are provided at the outlet 34 of the rain shield 10 such that the openings 36 are defined within a predetermined dimension D1; i.e., a dimension R1 about the center of the rain shield 10 at the outlet. For example, in the specific embodiment illustrated in FIG. 2, a dis-shaped end cover 38 is attached to the housing 30 by threads or the like and includes the openings 36. The interior of the housing 30 is generally open with the exception of a drip cap 40 and a sleeve 42.

The drip cap 40 is centrally located adjacent the outlet 34. The drip cap 40 includes a base portion 41 and a widened disk or plate section 43 which defines, via a rim 45, a shallow bowl-shaped section with the open end facing the inlet opening 32. In a preferred embodiment, the surface of the plate section 43 of the drip cap 40 includes circumferential grooves, e.g., 61, 62, and 63, which are located in alignment with predetermined portions of the openings 36 for purposes as will be explained hereinafter. The drip cap 40 is secured to the end cover 38 via suitable fastening arrangements generally indicated at 44.

The sleeve 42 with predetermined inner diameter D2 is affixed to the housing 30, for example, as shown in FIG. 1, by means of threaded portions 47 of the sleeve 42 and threaded portions 49 of the housing 30. The outer diameter of the plate section 43 of the drip cap 40 includes a dimension D3 which is greater than the dimension D2 of the sleeve 42 and also preferably greater than the outer diameter of the sleeve 42. The dimensions D1, D2, and D3 can also be referred to as being respective radii R1, R2, and R3 measured with respect to the centerline of the rain shield 10; the relationships being described as $D3>D1$, $D3>D2$, $R3>R2$, $R3>R1$. However, it should be realized that in other specific embodiments, the various dimensions and relationships may be generally equal to each other or the dimensions R1,D1 may be greater than the dimensions R3,D3 respectively.

Accordingly, if precipitation enters the openings 36 via the outlet 34, such precipitation will encounter the drip cap 40 so as to prevent entry of such precipitation to the inner portions of the sleeve 42, the inlet opening 32, and the outlet 13 of the circuit interrupter 12 as illustrated by the path 46. The sleeve 42 in combination with the interior wall of the housing 30 defines a reservoir generally referred to at 48. In summary, with the circuit interrupter 12 and the rain shield 10 in the inverted position of FIG. 1, precipitation encountering the drip cap 40 and following the path 46 accumulates in the reservoir 48. The circumferential grooves 61, 62, and 63 assist in breaking up large drops of precipitation while minimizing splattering and undesirable dispersement patterns of the precipitation after encountering the plate section 43.

Drain passages 50 are provided through the wall of the housing 30 to permit liquid accumulated in the reservoir 48 to be drained from the rain shield 10, thus avoiding any undue accumulation which might cause moisture to enter the interior of the sleeve 42, the inlet opening 32, and the exhaust outlet 13 of the circuit interrupter 12. It has been found desirable to fabricate the drain passages 50 with an inclination from the radial direction illustrated by line 60 and pointing toward the outlet 34 to advantageously direct exhaust gases and to prevent the ingress of precipitation when the circuit interrupter 12 is in the upright, circuit-operating position. Also, to this end, a protruding portion at 55 is provided on the exterior of the housing 30 with the drain passages 50 exiting the housing on the trailing surface of the protruding portion 55. Additionally, extending ledges 54 are provided on the exterior of the housing 30 and overhanging the drain passages 50. The extending ledges 54 minimize the ingress of precipitation to the drain passages 50 from the exterior of the housing 30. The extending ledges 54, in a specific embodiment as illustrated in FIGS. 3, 4, and 5, extend beyond the protruding portions 55 so as to extend approximately equal to the outer extent of the housing 30. In this regard, the housing 30 is wider at the portion adjacent the outlet 34 compared to the portion adjacent the inlet opening 32. In a specific embodiment as illustrated in FIGS. 3 and 4, the extending ledges 54 are triangularly shaped so as to divert any precipitation around the openings of the passages 50.

While the ingress of moisture to the circuit interrupter 12 is avoided, it can also be seen that exhaust gases being expelled from the outlet 13 of the circuit interrupter 12 travel through the interior of the housing 30 and specifically through the interior of the sleeve 42. After passing through the sleeve 42, the exhaust gases encounter the disk section 43 of the drip cap 40. By the indirect path, for example, as illustrated by the path 52 in FIG. 2, the exhaust gases pass around the drip cap 40 exiting the openings 36 at the outlet 34 of the rain cap 10.

Additionally, while the rain cap 10 achieves the goal of deterring the ingress of precipitation into the circuit interrupter 12, it can also be seen that the widened expanse of the inner walls at 31 of the housing 30, the sleeve 42, the drip cap 40, and the exhaust openings 36 are inter-related such that undue back pressures are not presented to the exhaust gases exiting the circuit interrupter 12. Thus, the exhaust gases are expelled therefrom while also providing the desired avoidance of the ingress of precipitation. This is optimally achieved in the present invention by a rain shield 10 which remains attached to the circuit interrupter 12 during circuit interruption while also being reusable. In the case of a disposable circuit interrupter 12, the rain shield 10 is disassembled from the circuit interrupter 12 and assembled onto an unused circuit interrupter 12.

While there have been illustrated and described various embodiments of the present invention, it will be apparent that various changes and modifications will occur to those skilled in the art. It is intended in the appended claims to cover all such changes and modifications as fall within the true spirit and scope of the present invention.

What is claimed and desired to be secured by Letters Patent of the United States is:

1. A shield for preventing the ingress of precipitation into an exhaust-outlet opening of an expulsion-type electrical device that exhausts gases through the exhaust outlet, and for permitting the egress of exhaust gases to the atmosphere, the shield comprising:

a housing defining a shield outlet, and an inlet opening arranged for communication with the exhaust outlet of the electrical device; and first means for preventing precipitation that enters said shield outlet from thereafter entering said inlet opening while at the same time providing an indirect path for the exhaust gases from said inlet opening to said shield outlet, said first means comprising fluid-directing means for directing fluid that enters the interior of said housing via said shield outlet to a point exterior of said housing, said first means further comprising means for defining a predetermined pattern of openings at said shield outlet, and a first member arranged interiorly of said housing intermediate said inlet opening and said shield outlet and having predetermined dimensions related to said predetermined pattern of openings and said inlet opening such that said first member shields said inlet opening from the direct entry of precipitation that enters said shield outlet, said first means further comprising a second member adjacent said inlet opening that defines a central opening having dimensions less than said predetermined dimensions of said first member.

2. The shield of claim 1 wherein said predetermined dimensions of said first member are at least equal to the expanse of said predetermined pattern of openings.

3. The shield of claim 1 wherein said openings in said predetermined pattern of openings are tapered so as to decrease toward the interior of said housing.

4. The shield of claim 1 wherein said fluid-directing means further comprises reservoir means defined between the exterior of said second member and the interior of said housing for receiving fluid that enters said shield outlet.

5. The shield of claim 4 wherein said reservoir means communicates with the exterior of said housing.

6. The shield of claim 1 wherein said second member is a cylindrical sleeve.

7. The shield of claim 1 wherein said first member includes a first portion having dimensions that exceed said central opening of said second member.

8. The shield of claim 7 wherein said first member further includes a rim about the periphery of said first portion such that said rim extends toward said central opening of said second member.

9. The shield of claim 7 wherein said first member further includes a central portion having a dimension smaller than said first portion and a smoothly curved portion intermediate said central portion and said first portion, said central portion facing said shield outlet.

10. The shield of claim 1 wherein said fluid-directing means comprises one or more passages communicating the interior of said housing to the exterior of said housing.

11. The shield of claim 10 wherein said one or more passages are inclined toward said outlet end of said housing as said passage traverses said housing from interior to exterior.

12. The shield of claim 11 further comprising protruding means on the exterior of said housing in the vicinity of each of said one or more passages, said protruding means comprising a surface that is sloped inwardly toward said housing exterior and toward said shield outlet, each of said one or more passages exiting said exterior of said housing on one of said surfaces.

13. The shield of claim 10 further comprising means on the exterior of said housing and adjacent each of said one or more passages for reducing the ingress of precipitation into said one or more passages and the interior of said housing when said shield is oriented with said shield outlet generally upward.

14. The shield of claim 1 further comprising means carried by said housing for securing the electrical device to said housing and means for cooperating with an electrical device mounting.

15. The shield of claim 1 wherein a first surface of said first member facing said predetermined pattern of openings includes a concave portion.

16. The shield of claim 1 wherein a first surface of said first member facing said predetermined pattern of openings includes a predetermined surface pattern to define an undulating surface of ridges and grooves.

17. The shield of claim 1 wherein a first surface of said first member facing said shield outlet includes a circumferential pattern of undulations.

18. A shield adapted to be affixed to an expulsion-type circuit interrupter that exhausts gases through an exhaust outlet, the shield remaining affixed to the circuit interrupter during circuit-interrupting operation while providing a path for the egress of exhaust gases, the shield comprising:

a generally cylindrical housing defining an inlet at one end and a shield outlet at an opposite end, said inlet opening being adapted to communicate with the exhaust outlet of the circuit interrupter;

first means for further defining said shield outlet including one or more openings;

second means communicating with said inlet and interiorly of said housing for defining a central opening of predetermined dimension R2 about the centerline of said housing; and third means arranged interiorly of said housing for preventing precipitation that enters said shield outlet from entering said central opening, said third means including a third member arranged about the centerline of said housing and having a predetermined dimension R3 about said centerline, where R3 is greater than or equal to R2, said third means further comprising means for directing fluid that enters said shield outlet and encounters said third member exteriorly of said housing.

19. The shield of claim 18 wherein said one or more openings in said first means being arranged within a predetermined dimension R1 of the centerline of said housing, R3 is greater than or equal to R1, said predetermined dimension R1 being measured adjacent said third member.

20. A shield for preventing the ingress of precipitation into an exhaust-outlet opening of an expulsion-type electrical device that exhausts gases through the exhaust outlet, and for permitting the egress of exhaust gases to the atmosphere, the shield comprising:

a housing defining a shield outlet, and an inlet opening arranged for communication with the exhaust outlet of the electrical device;

first means for preventing precipitation that enters said shield outlet from thereafter entering said inlet opening while at the same time providing an indirect path for the exhaust gases from said inlet opening to said shield outlet, said first means comprising fluid-directing means for directing fluid that enters the interior of said housing via said shield outlet to a point exterior of said housing, said fluid-directing means comprising one or more passages communicating the interior of said housing to the exterior of said housing, said first means further comprising means for defining a predetermined pattern of openings at said shield outlet, and a first member arranged interiorly of said housing intermediate said inlet opening and said shield outlet and having predetermined dimensions related to said predetermined pattern of openings and said inlet opening such that said first member shields said inlet opening from the direct entry of precipitation that enters said shield outlet; and protruding means extending outwardly from said housing beyond said housing portions adjacent said one or more passages, said protruding means being located toward said shield outlet relative to said one or more passages.

21. The shield of claim 20 wherein said protruding means comprises respective triangularly shaped portions extending on either side of a respective one of said one or more passages, the apex of each of said triangularly shaped portions being generally aligned with a respective passage such that the base of said triangularly shaped portion is intermediate said apex and said passage, and said respective apex and passage define a line pointing generally directly toward said shield outlet.

22. A shield for preventing the ingress of precipitation into an exhaust-outlet opening of an expulsion-type electrical device that exhausts gases through the exhaust outlet, and for permitting the egress of exhaust gases to the atmosphere, the shield comprising:

a housing defining a shield outlet, and an inlet opening arranged for communication with the exhaust outlet of the electrical device; and first means for preventing precipitation that enters said shield outlet from thereafter entering said inlet opening while at the same time providing an indirect path for the exhaust gases from said inlet opening to said shield outlet, said first means comprising fluid-directing means for directing fluid that enters the interior of said housing via said shield outlet to a point exterior of said housing, said first means further comprising means for defining a predetermined pattern of openings at said shield outlet, and a first member arranged interiorly of said housing intermediate said inlet opening and said shield outlet and having predetermined dimensions related to said predetermined pattern of openings and said inlet opening such that said first member shields said inlet opening from the direct entry of precipitation that enters said shield outlet, a first surface of said first member facing said predetermined pattern of openings including a predetermined surface pattern to define grooves.

* * * * *